US007277013B2

(12) United States Patent
Yen

(10) Patent No.: US 7,277,013 B2
(45) Date of Patent: Oct. 2, 2007

(54) ROBBERY-PREVENTING AND BODY-PROTECTING HANDBAG

(76) Inventor: Man-Sheng Yen, 6F., No. 33, Alley 3, Lane 236, Sec. 5, Jhongsiao E. Rd., Taipei City (TW) 110

( * ) Notice: Subject to any disclaimer, the term of this patent is extended or adjusted under 35 U.S.C. 154(b) by 293 days.

(21) Appl. No.: 10/987,160

(22) Filed: Nov. 15, 2004

(65) Prior Publication Data

US 2006/0102260 A1 May 18, 2006

(51) Int. Cl.
*G08B 13/14* (2006.01)

(52) U.S. Cl. ..... 340/568.7; 340/568.1; 340/571; 150/102; 150/110

(58) Field of Classification Search ..... 340/571, 340/568.7, 568.1, 541, 546, 568.6, 568.4; 150/102, 109, 110
See application file for complete search history.

(56) References Cited

U.S. PATENT DOCUMENTS 4,755,802 A * 7/1988 Urbanczyk ..... 340/571
4,885,570 A * 12/1989 Chien ..... 340/571
5,178,198 A * 1/1993 Fitzgerald ..... 150/107
6,179,025 B1 * 1/2001 Sutton ..... 150/105
6,340,235 B1 * 1/2002 Bryan ..... 362/156
7,064,667 B2 * 6/2006 Sosna ..... 340/568.7

* cited by examiner

*Primary Examiner*—Anh V. La
(74) *Attorney, Agent, or Firm*—Bacon & Thomas, PLLC

(57) ABSTRACT

A robbery-preventing and body-protecting handbag includes a bag body, an automatic disengaging device, a circuit control device, a buzzer and a shoulder strap. The automatic disengaging device is installed between the bag body and the shoulder strap, having separable magnetic attraction members combined with the end of the shoulder strap and stationary magnetic attraction members combined with the bag body. The stationary magnetic attraction members are connected with the circuit control device and the buzzer to form an automatic alarm circuit. When the shoulder strap is forcefully dragged by a robber or by a user herself, the separable magnetic attraction members will be disengaged from the stationary magnetic attraction members and the circuit control device will simultaneously start the buzzer to scare the robber away, ensuring safety of the handbag and the user.

3 Claims, 9 Drawing Sheets

ROBBERY-PREVENTING AND BODY-PROTECTING HANDBAG

BACKGROUND OF THE INVENTION

1. Field of the Invention

This invention relates to a robbery-preventing and body-protecting handbag, particularly to one formed with an automatic alarm circuit, able to have the shoulder strap quickly disengaged from the bag body and simultaneously give out alarm sounds to scare robbers away when the shoulder strap is suddenly and forcefully dragged by the robbers.

2. Description of the Prior Art

A conventional handbag on the market is generally composed of a bag body and a shoulder strap firmly combined together by sewing or by hooking. Nowadays, public security is from bad to worse and robberies committed by motorcyclists have occurred occasionally. When motorcycle robbers meet with a lady who hangs such a conventional handbag on her shoulder, they will wait for a chance to rob her of her handbag by suddenly and forcefully grasping and dragging the shoulder strap of her handbag. Such unexpected and forceful dragging of the shoulder strap of the handbag always causes stumbling and injury to a victim, and what is worse, if the victim firmly holds her handbag in her arms for protecting the valuables therein, the victim may be dragged by force and abruptly falls down to get seriously injured. Especially, we cannot imagine what may happen if the victim is a pregnant woman, as shown in FIG. 1.

As a matter of fact, whether on the internal markets or on the external markets, we can hardly find any conventional handbag that can be kept safe when its shoulder strap is unexpectedly and forcefully dragged by robbers. This is because the shoulder strap and the bag body of the conventional handbag are fixedly combined together and impossible to be instantly separated from each other.

SUMMARY OF THE INVENTION

The objective of the invention is to offer a robbery-preventing and body-protecting handbag that is able to have its shoulder strap quickly disengaged from its bag body and automatically give out alarm sounds as soon as the shoulder strap is forcefully dragged by robbers, able to scare the robbers away and ensure safety of the user.

The robbery-preventing and body-protecting handbag in the present invention includes a bag body, an automatic disengaging device, a circuit control device, a buzzer and a shoulder strap combined together. The automatic disengaging devices is provided between the bag body and the shoulder strap and composed of a pair of separable magnetic attraction members combined with the end of the shoulder strap and a pair of stationary magnetic attraction members combined with the bag body, with the separable and the stationary magnetic attraction members able to be combined together by mutual magnetic attraction. By so designing, the shoulder strap can automatically separate from the bag body when the separable magnetic attraction members are disengaged from the stationary magnetic attraction members, able to keep the bag body safe.

The two stationary magnetic attraction members are secured in a stationary base installed at the outer side of the bag body and have their upper ends respectively bored with an accommodating recess for the separable magnetic attraction member at the end of the shoulder strap to be inserted therein and combined with the stationary magnetic attraction member by mutual magnetic attraction to make up a complete handbag.

In addition, the stationary base is provided at the lower side with a pair of pins connected with the circuit control device and the buzzer to form an automatic alarm circuit. Thus, as soon as the separable magnetic attraction members of the shoulder strap are disengaged from the stationary magnetic attraction members of the bag body, the circuit control device will automatically start the buzzer to give out alarm sounds to scare the robbers away to protect safety of the user.

BRIEF DESCRIPTION OF DRAWINGS

This invention will be better understood by referring to the accompanying drawings, wherein.

DETAILED DESCRIPTION OF THE PREFERRED EMBODIMENT

Figure 2:
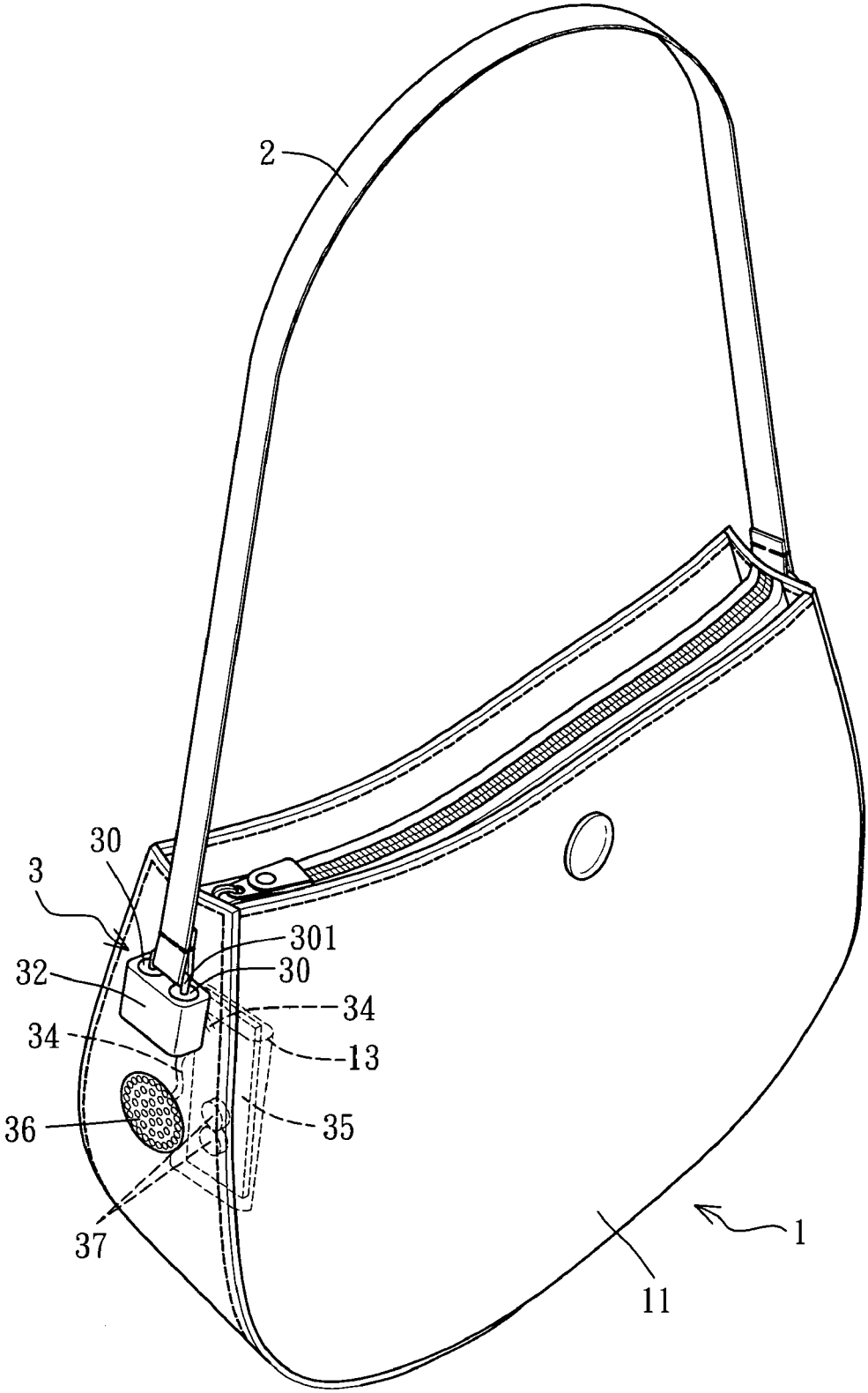
FIG. 2 is a perspective view of a first preferred embodiment of a robbery-preventing and body-protecting handbag in the present invention.
Figure 3:
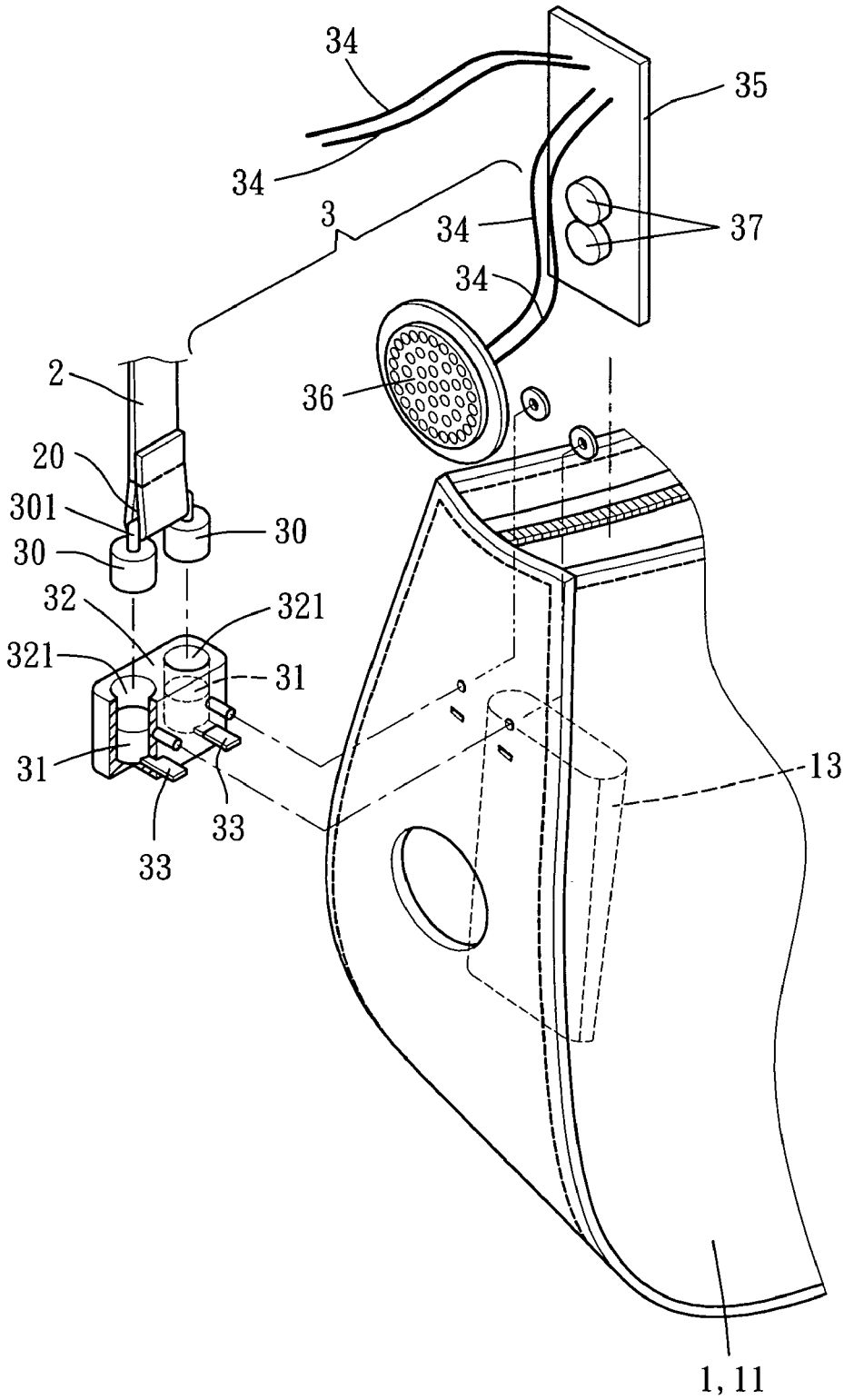
FIG. 3 is a partial exploded perspective view of the first preferred embodiment of the robbery-preventing and body-protecting handbag in the present invention.
Figure 4:
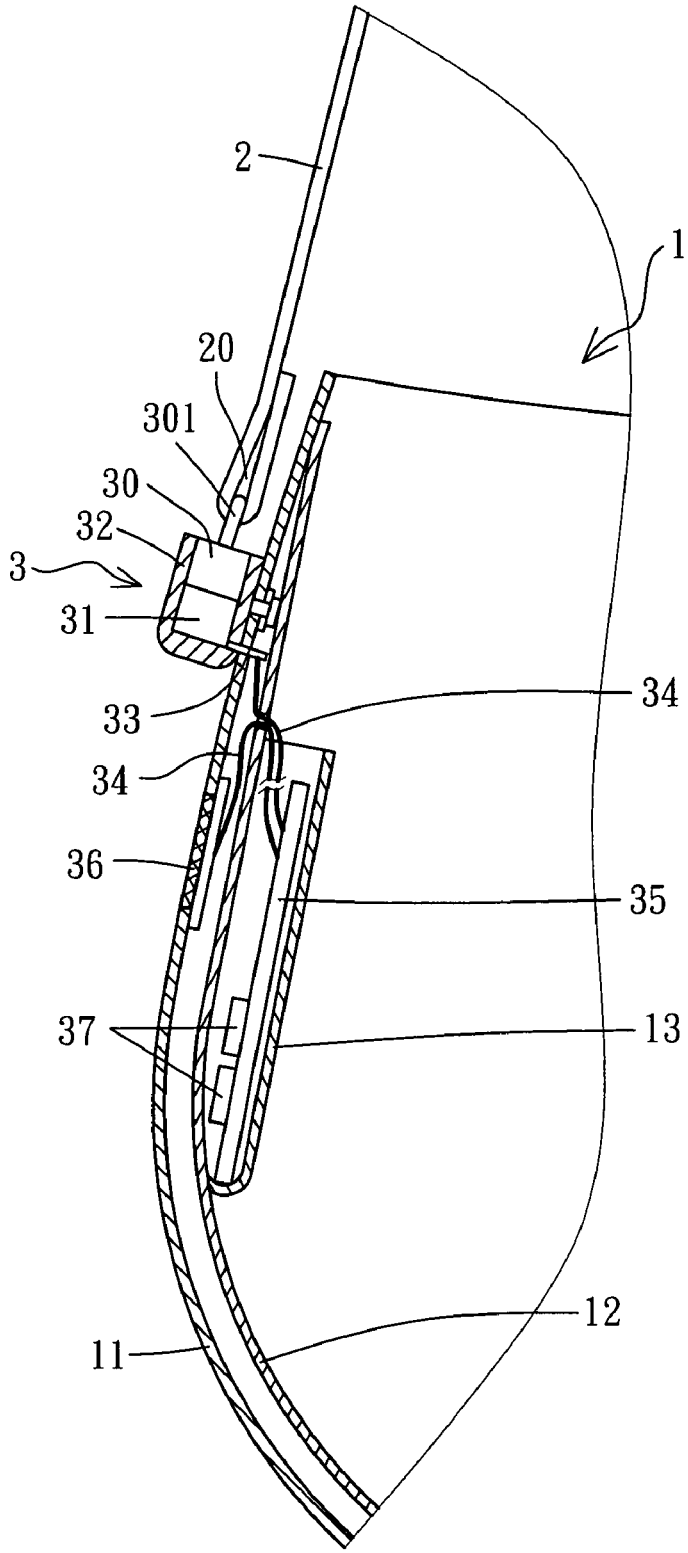
FIG. 4 is a partial cross-sectional view of the first preferred embodiment of the robbery-preventing and body-protecting handbag in the present invention.

A first preferred embodiment of a robbery-preventing and body-protecting handbag in the present invention, as shown in FIGS. 2, 3 and 4, includes a bag body 1, a shoulder strap 2, an automatic disengaging device 3, a circuit control device 35 and a buzzer 36 combined together.

The bag body 1 consists of an outer leather layer 11 and an inner layer 12 that has its interior provided with an inner bag 13 with a receiving space of a proper size.

The shoulder strap 2 has its opposite ends respectively folded reversely and sewed to form an insert hollow 20.

The automatic disengaging device 3 is composed of a stationary base 32 and a pair of separable magnetic attraction members 30. The stationary base 32 is secured inside with a pair of cylindrical stationary magnetic attraction members 31 with great magnetic attractive force, and an accommodating recess formed on each stationary magnetic attraction member 31 for receiving the separable magnetic member 30. The stationary base 32 is further provided with a pair of insert pins 33 at one lower side facing the bag body 1 and respectively connected with the two stationary magnetic attraction members 31. The two insert pins 33 are connected with the circuit control device 35 by wires 34, and the circuit control device 35 is connected with the buzzer 36 by other wires 34 and has batteries 37 installed thereon for supplying electric power. Thus, the circuit control device 35, the buzzer 36 and the stationary magnetic attraction members 31 together with the separable magnetic attraction members 30 are connected together to form an automatic alarm circuit. This automatic alarm circuit is designed as follows: when the separable magnetic attraction members 30 and the stationary magnetic attraction members 31 are combined together by mutual magnetic attraction, the buzzer 36 is electrically disconnected, impossible to give out alarm sounds, but as soon as the separable magnetic attraction members 30 are disengaged from the stationary magnetic attraction members 31, the buzzer 36 will be electrically connected to give out alarm sounds.

Further, the pair of separable magnetic attraction members 30 are shaped a cylinder with great magnetic attractive force, connected by a U-shaped connecting rod 301 that is inserted in the insert hollow 20 at the end of the shoulder strap 2 and positioned therein. The pair of separable magnetic attraction members 30 are to be respectively inserted and positioned in the two accommodating recesses 321 of the stationary base 32 and combined with the pair of stationary magnetic attraction members 31 by mutual magnetic attraction. Additionally, the separable magnetic attraction members 30, the stationary magnetic attraction members 31, the U-shaped connecting rod 301 and the insert pins 33 are all good conductors.

In assembling, as shown in FIG. 4, firstly, the stationary base 32 of the automatic disengaging device 3 are secured at the outer sides of the bag body 1 by riveting, letting the insert pins 33 of the stationary base 32 inserted through the outer leather layer 11 of the bag body 1 and connected with the circuit control device 35 in the inner bag 13 inside the bag body 1 by the wires 34. Then, the buzzer 36 is connected with the circuit control device 35 by the other wires 34 and positioned at a proper portion of the outer leather layer 11 of the bag body 1, preferably exposed to the outer side of the bag body 1 to be seen by robbers for warning them to give up bad intention. However, the automatic disengaging device 3 and the buzzer 36 can be hidden in the handbag or exposed on the outer side. The wires 34 respectively connecting the stationary base 32 with the circuit control device 35 and connecting the circuit control device 35 with the buzzer 36 are wound and deposited in between the outer leather layer 11 and the inner layer 12 of the bag body 1 for facilitating pulling out the circuit control device 35 for replacing the batteries 37 with new ones. Next, the U-shaped connecting rod 301 on the topside of the two separable magnetic attraction members 30 is inserted through the insert hollow 20 of the shoulder strap 2 and positioned astride therein. Lastly, the separable magnetic attraction members 30 are respectively inserted and positioned in the two accommodating recesses 321 of the stationary base 32 and combined with the stationary magnetic attraction members 31 by mutual magnetic attraction. Thus, the automatic alarm circuit is completed, but in this position, the buzzer 36 remains electrically disconnected.

Through tests in weight and pulling force, it is proved that after the separable magnetic attraction members 30 and the stationary magnetic attraction members 31 are combined together by mutual magnetic attractive force, their combination strength is great enough to bear the weight of the articles in the handbag. So it is needless to worry that the separable and the stationary magnetic attraction members 30, 31 might be disengaged from each other without exterior force.

However, in case the shoulder strap 2 is dragged suddenly by a tremendous external force, the separable magnetic attraction members 30 will be disengaged from the stationary magnetic attraction members 31 and so will the shoulder strap 2 be separated from the bag body 1, letting the robbers only take away the worthless shoulder straps 2 but the victim can still keep safe the valuable bag body 1. Further, the moment the separable magnetic attraction members 30 are disengaged from the stationary magnetic attraction members 31, the circuit control device 35 will synchronously start the buzzer 36 to give out harsh alarm sounds to frighten the robbers, at the same time arousing attention of the people around, and brave persons may try to catch the robbers. Even in an out-of-the-way place, the harsh alarm sounds given out by the buzzer 36 of the handbag still can scare the robbers away to keep the handbag safe and also guard the user from being hurt.

Figure 6:
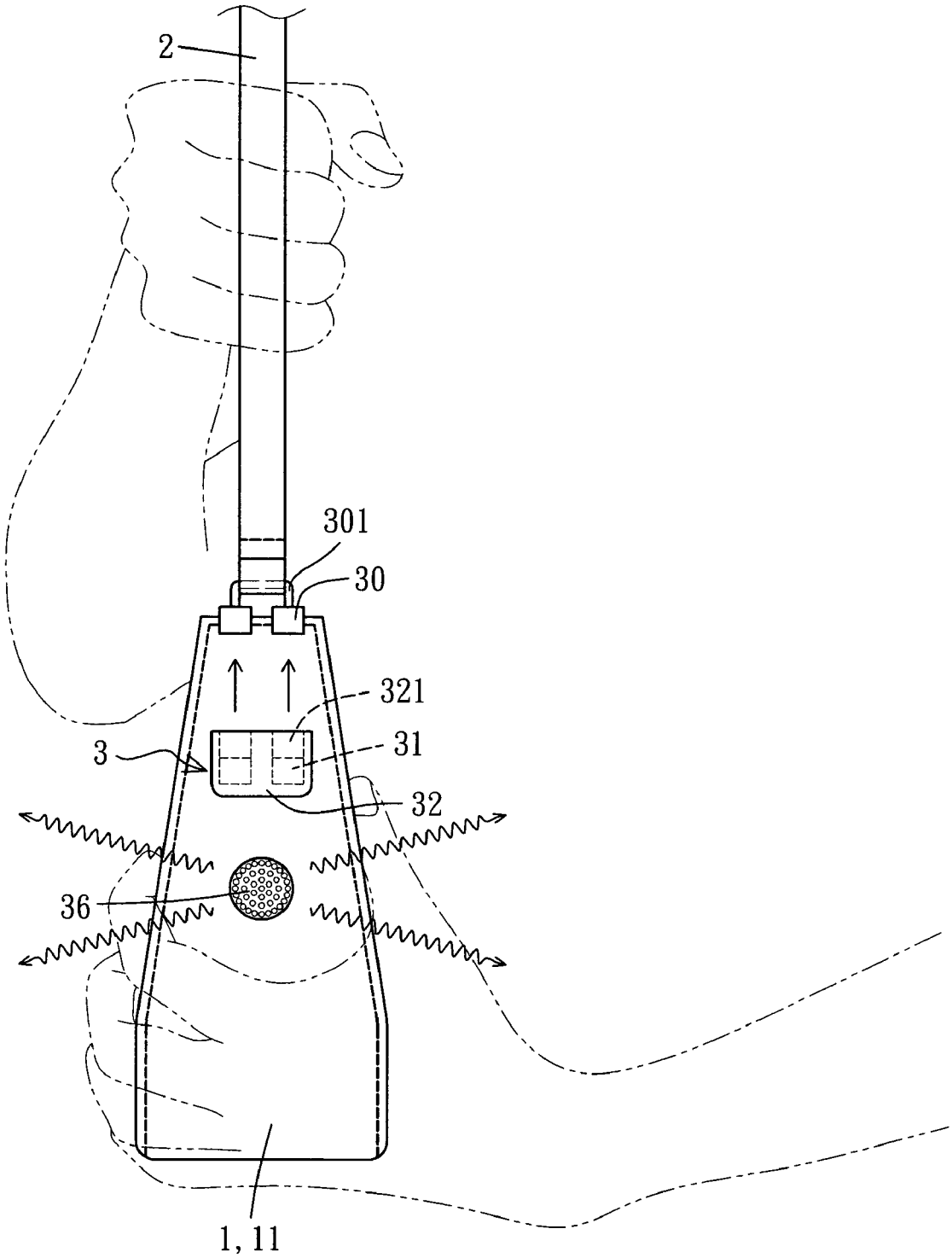
FIG. 6 is a side view of the first preferred embodiment of the robbery-preventing and body-protecting handbag in the present invention, showing the shoulder strap is dragged by the user herself and the buzzer of the handbag is started to give out alarm sounds.

In addition, if a lady stays alone and robbery or assault should happen, she can exert strength to drag the shoulder strap 2 by herself to let the separable magnetic attraction members 30 disengaged from the stationary magnetic attraction members 31, as shown in FIG. 6, and simultaneously start the buzzer 36 to give out alarm sounds to arouse attention of other people and scare the robbers away, thus ensuring a user's safety. To stop the alarm sounds, simply insert the separable magnetic attraction members 30 into the accommodating recesses 321 of the stationary base 32 to be combined with the stationary magnetic attraction members 31.

Figure 7:
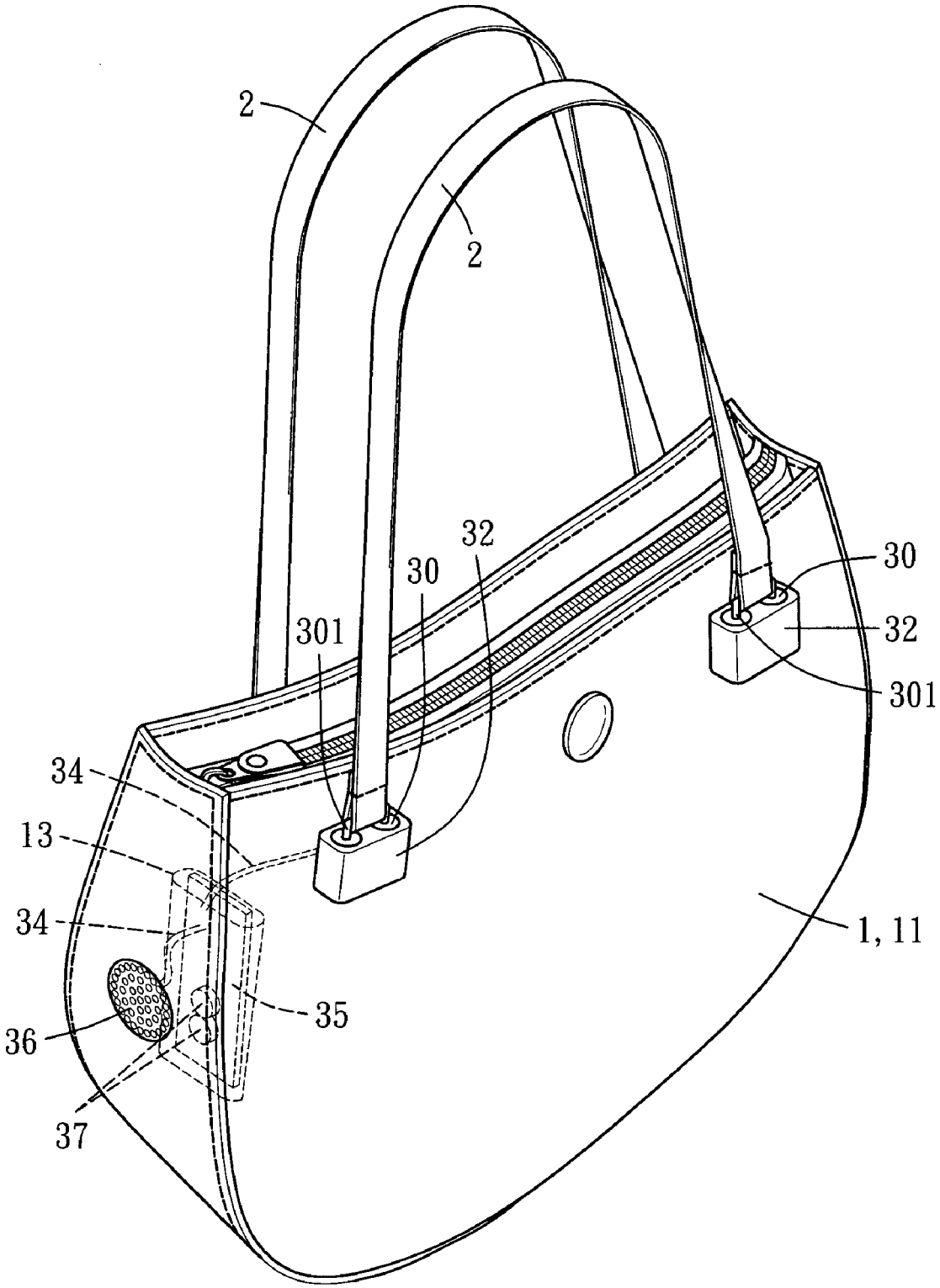
FIG. 7 is a perspective view of another style of the robbery-preventing and body-protecting handbag in the present invention.

A part from being fixed at the opposite edges of a handbag with a single shoulder strap, the stationary base 32 of the automatic disengaging device 3 of this invention can also be fixed at the front and the rear side of a handbag with two shoulder straps, equally having functions of robbery prevention and body protection, as shown in FIG. 7.

As can be understood from the above description, this invention has the following functions that a conventional handbag does not have.

1. The stationary magnetic attraction members 31 secured at the bag body 1 and the separable magnetic attraction members 30 secured at the shoulder strap 2 are combined by mutual magnetic attraction; therefore, when the shoulder strap 2 is dragged by force, it will automatically separate from the bag body 1, able to keep safe the bag body 1.

2. The buzzer 36 can immediately give out alarm sounds to scare robbers away as soon as the shoulder strap 2 is dragged by force and separated from the bag body 1, ensuring safety of both the bag body 1 and the user.

Figure 8:
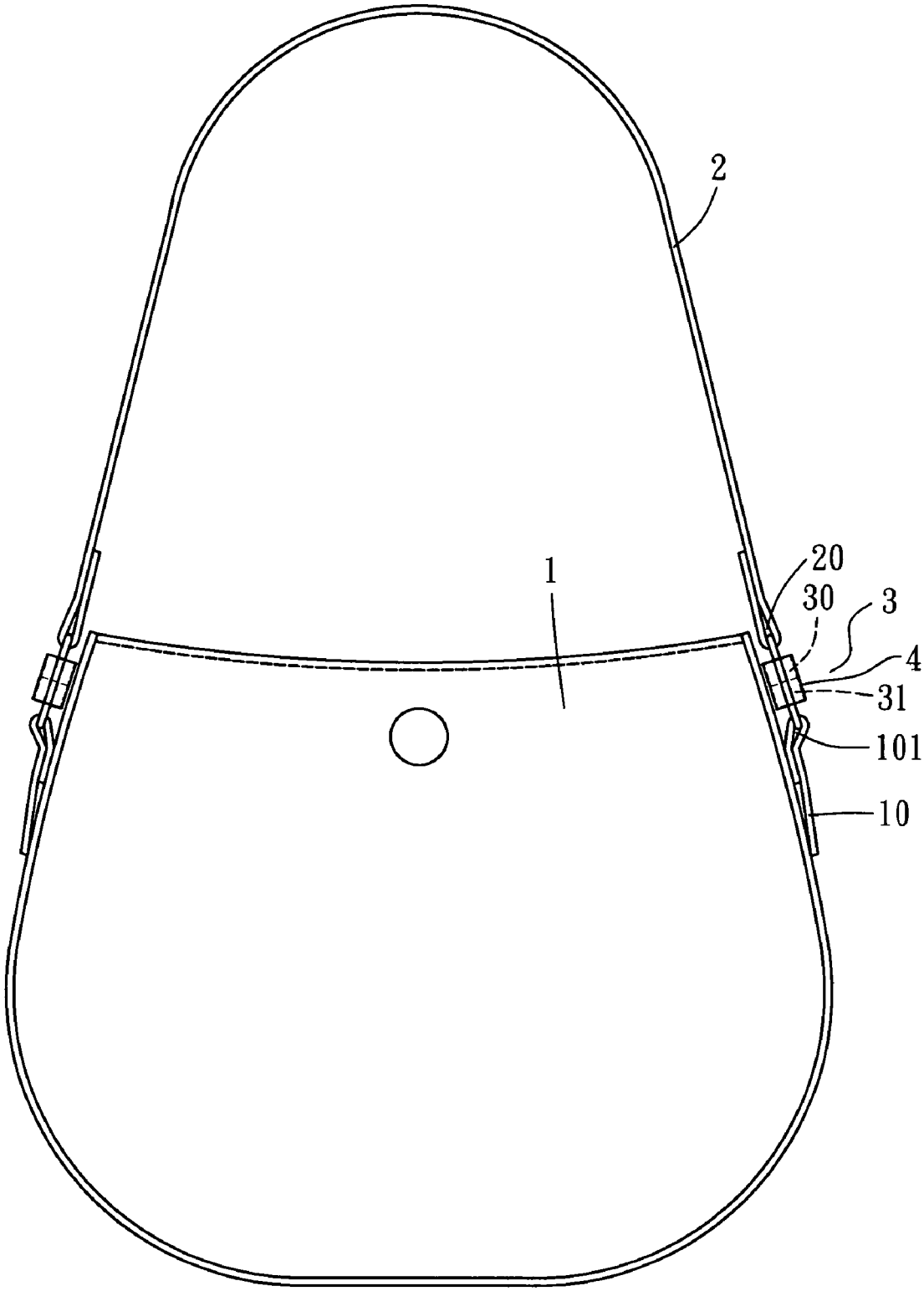
FIG. 8 is a front view of a second preferred embodiment of a robbery-preventing and body-protecting handbag in the present invention.
Figure 9:
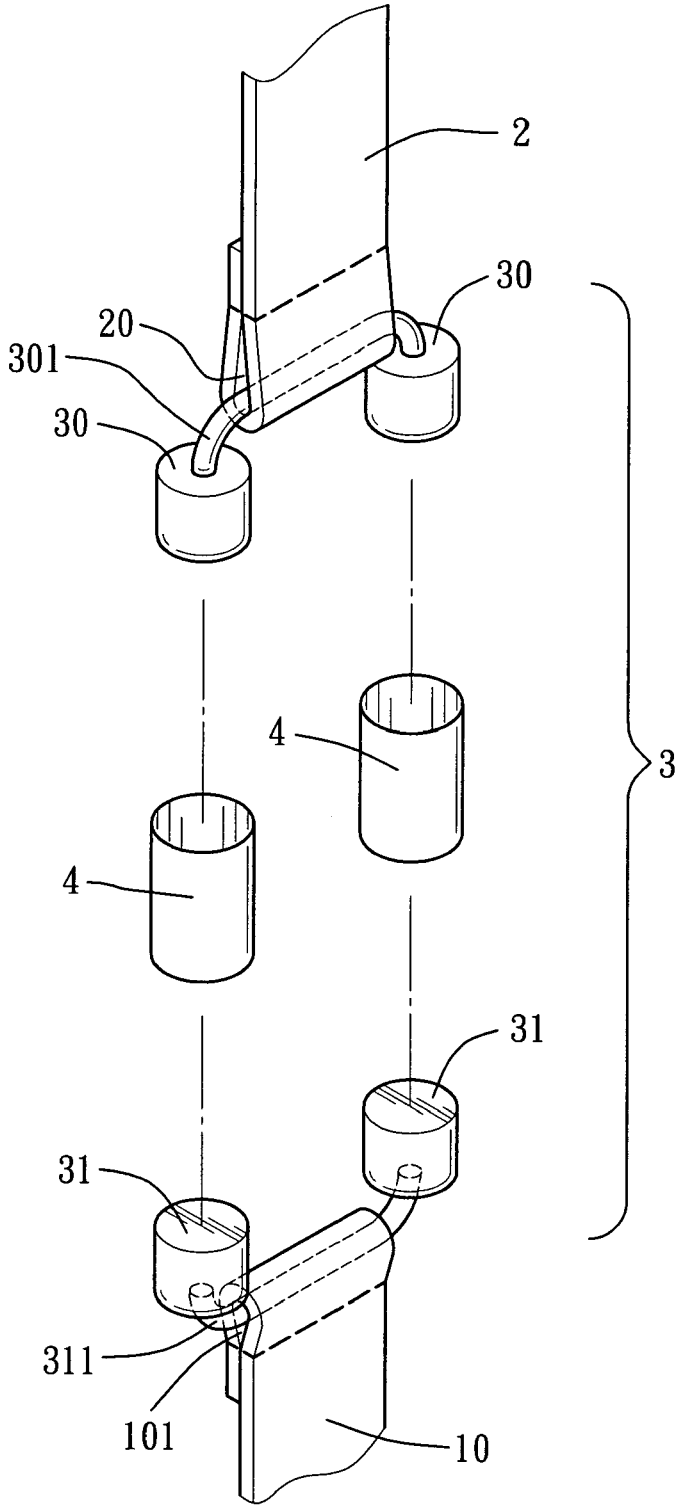
FIG. 9 is a partial exploded perspective view of the second preferred embodiment of the robbery-preventing and body-protecting handbag in the present invention.

A second preferred embodiment of the robbery-preventing and body-guarding handbag in the present invention, as shown in FIGS. 8 and 9, has almost the same structure as that of the first preferred embodiment, except that it is provided with no circuit control device 35 and buzzer 36. The handbag in the second preferred embodiment has the opposite edges of the bag body 1 respectively sewed with a short connecting strap 10 with an insert hollow 101 for a U-shaped connecting rod 311 to be inserted and positioned therein. The stationary magnetic attraction members 31 are secured on the U-shaped connecting rod 311 to be combined with the separable magnetic attraction members 30 at the opposite ends of the shoulder strap 2 by mutual magnetic attraction. After the stationary and the separable magnetic attraction members 31 and 30 are combined by mutual magnetic attraction, their outer circumferential side is covered up with a decorative sleeve 4 for beautifying the appearance. Thus, the stationary magnetic attraction members 31 of the bag body 1 and the separable magnetic attraction members 30 of the shoulder strap 2 can instantly be disengaged from each other when the shoulder strap 2 is forcefully dragged by robbers, able to keep safe the bag body 1. The feature of the second preferred embodiment is that the short connecting strap 10 and the stationary magnetic attraction members 31 combined with the connecting strap 10 become parts of the bag body 1.

Evidently, the automatic disengaging device of this invention is mainly composed of the separable magnetic attraction members and the stationary magnetic attraction members combined together by mutual magnetic attraction, whether there are stationary bases provided or not.

Additionally, metallic members can be employed to substitute for the separable magnetic attraction members or the stationary magnetic attraction members of the automatic disengaging device of this invention so long as the metallic members and the separable magnetic attraction members or the stationary magnetic attraction members can be combined together by magnetic attraction and disengaged from each other.

Figure 1:
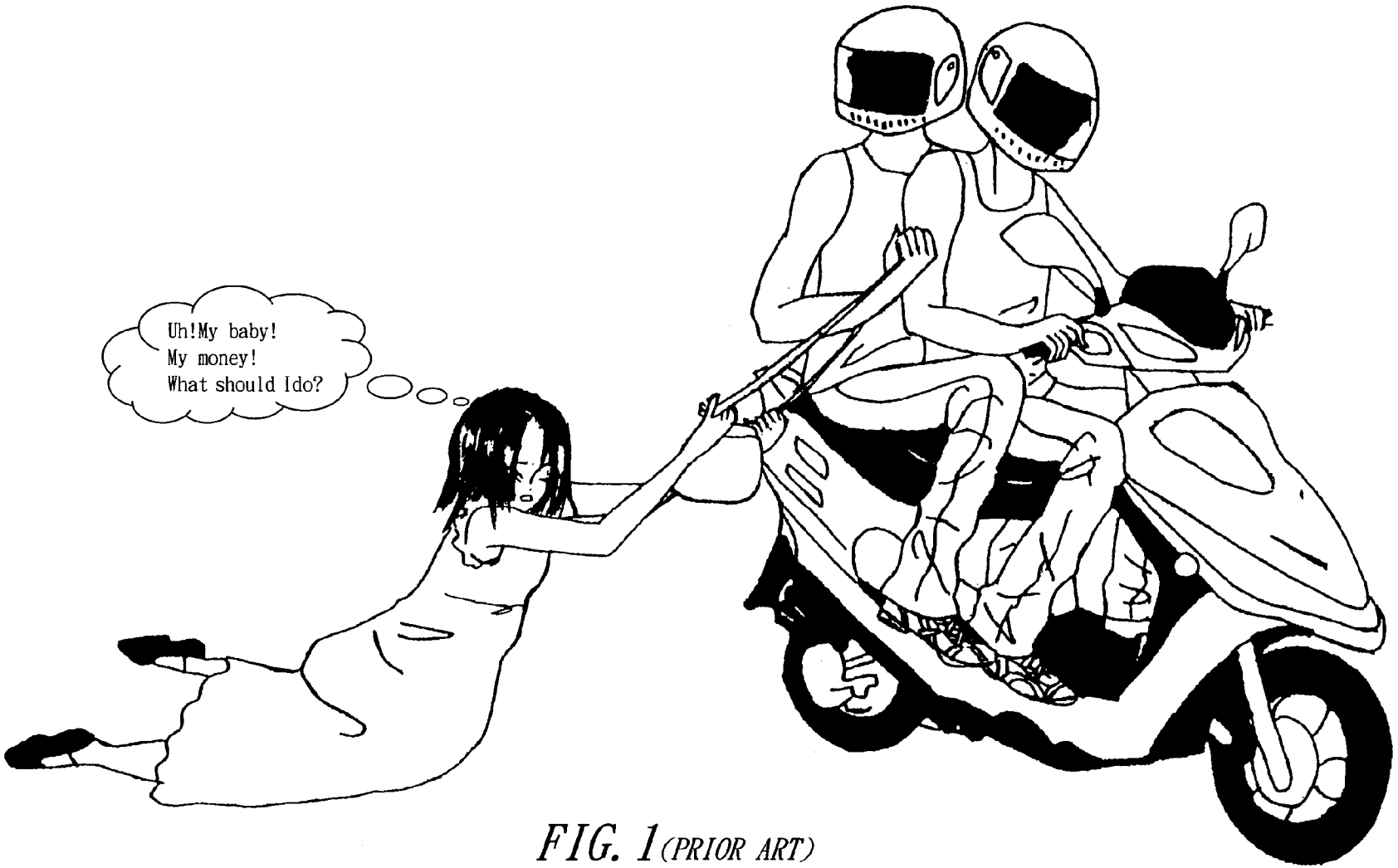
FIG. 1 (PRIOR ART)
FIG. 1 is a picture showing that when a conventional handbag is suddenly dragged by motorcycle robbers, the victim is likely to be pulled to fall down on the ground and get wounded.
Figure 5:
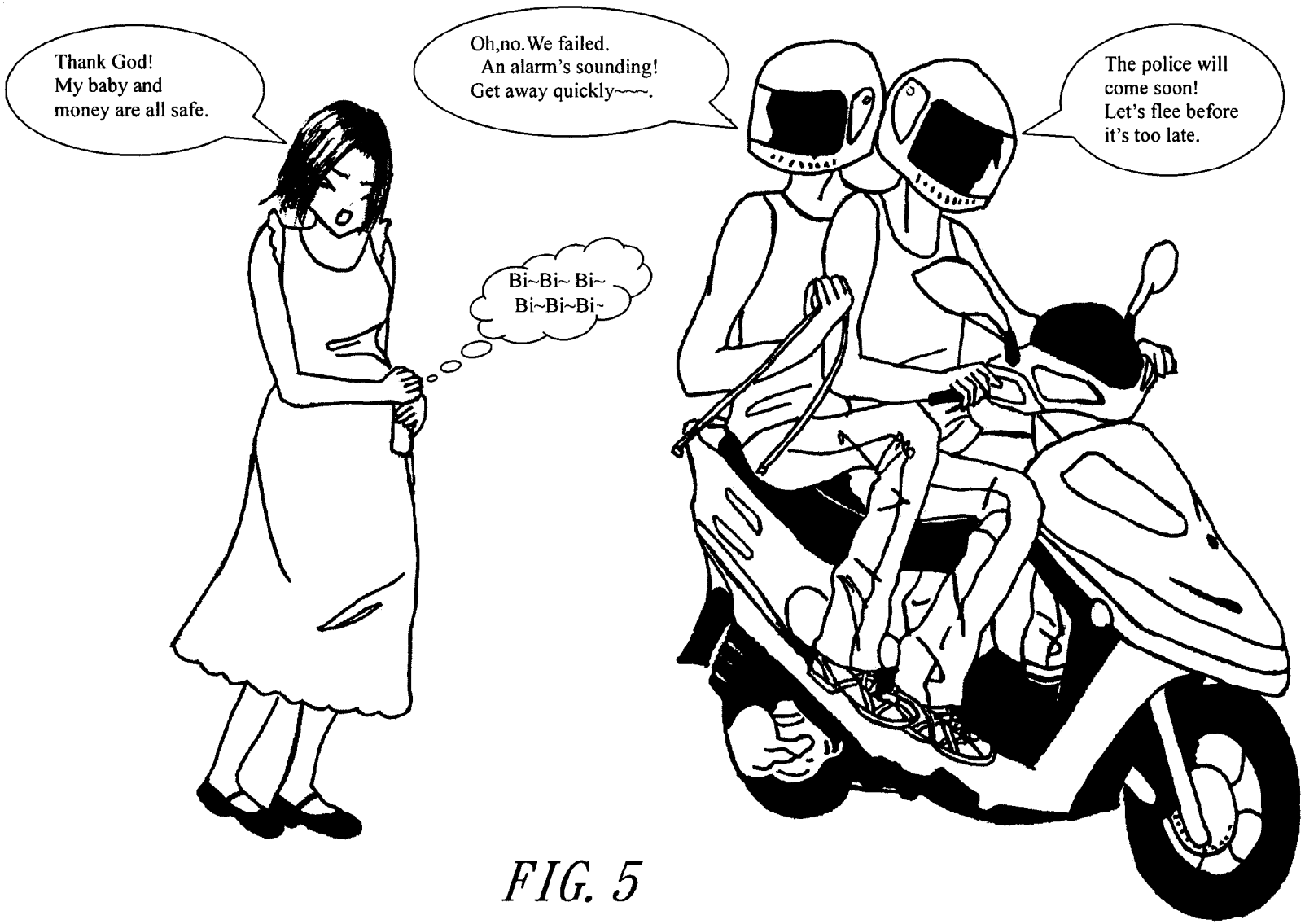
FIG. 5 is a picture showing that the motorcycle robbers fail in robbing a lady of the handbag of this invention.

The structure of the robber-preventing and body-protecting handbag can not only protect the bag from stolen, but also protect the body of a user, so an awful robbery shown in FIG. 1 never happens. Further, a baby and the money of a woman unexpectedly trapped in a robbery can be secured safely by the handbag in the invention, in a way shown in FIG. 5. In addition, the alarm device in the handbag can sound out an alarm loud enough to frighten away a bad guy. Therefore, the handbag in the invention is a defensive weapon of intellectual type, a great blessing and a great contribution also for both weak females and social security.

While the preferred embodiments of the invention have been described above, it will be recognized and understood that various modifications may be made therein and the appended claims are intended to cover all such modifications that may fall within the spirit and scope of the invention.

I claim:

1. A robbery-preventing and body-protecting handbag comprising a bag body, an automatic disengaging device and a shoulder strap, said automatic disengaging device provided between said bag body and said shoulder strap, said automatic disengaging device composed of separable magnetic attraction members and stationary magnetic attraction members, said separable magnetic members combined with the end of said shoulder strap, said stationary magnetic attraction members combined at said bag body, said separable magnetic attraction members and said stationary magnetic attraction members able to be combined together by mutual magnetic attraction, said shoulder strap and said bag body automatically separated from each other when said separable magnetic attraction members are disengaged from said stationary magnetic attraction members.

2. The robbery-preventing and body-protecting handbag as claimed in claim 1, wherein said bag body has provided with a stationary base having said stationary magnetic attraction members secured therein, an accommodating recess formed on each said stationary magnetic attraction members, said separable magnetic attraction members of said shoulder strap inserted into said accommodating recesses and combined with said stationary magnetic attraction members by mutual magnetic attraction.

3. The robbery-preventing and body-protecting handbag as claimed in claim 2, wherein said stationary base has provided with a pair of insert pins respectively connected with said stationary magnetic attraction members, said insert pins having their outer ends connected with a circuit control device that is connected with a buzzer to form an automatic alarm circuit, said circuit control device automatically starting said buzzer to give out alarm sounds as soon as said separable magnetic attraction members and said stationary magnetic attraction members are disengaged from each other.

* * * * *